US005996526A

United States Patent [19]

Sunderland

[11] Patent Number: 5,996,526

[45] Date of Patent: Dec. 7, 1999

[54] REFLECTOR FOR WATERCRAFT

[76] Inventor: Jeffery M. Sunderland, 6714 StrawTurkey Ct., Columbia, Md. 21046

[21] Appl. No.: 09/035,657

[22] Filed: Mar. 6, 1998

[51] Int. Cl.[6] ..... B63B 35/00

[52] U.S. Cl. ..... 114/343

[58] Field of Search ..... 359/515, 529, 359/534; 116/63 R, 63 P; 114/343, 364

[56] References Cited

U.S. PATENT DOCUMENTS

| | | | |
|---|---|---|---|
| 3,547,516 | 12/1970 | Shanok et al. . | |
| 4,819,135 | 4/1989 | Padilla et al. | 362/72 |
| 4,843,994 | 7/1989 | Wilson et al. | 114/219 |
| 4,977,851 | 12/1990 | Anderson | 116/63 R |
| 5,113,781 | 5/1992 | Link | 114/364 |
| 5,273,399 | 12/1993 | Ojeda | 440/49 |
| 5,731,895 | 3/1998 | Owczarzak et al. | 359/515 |

*Primary Examiner*—Ed Swinehart
*Attorney, Agent, or Firm*—Donald A. Kettlestrings

[57] ABSTRACT

A reflector device that is easily attached and/or removed from a boat's anchor lightpole, deck railing, or any other suitably sized exterior feature. The device "shines" only when illuminated by the spot/search light of an approaching boat, to provide a visual identification in dark or unfavorably lit conditions. The device supplements, but does not replace traditional electric or battery operated anchor lights, and serves as a stand-by should the traditional light fail. The device is passive, activated only when illuminated by the spot/search light of an approaching vessel.

2 Claims, 2 Drawing Sheets

REFLECTOR FOR WATERCRAFT

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

Personal pleasure craft that are at anchor at night display a white light (usually powered by a battery) to identify their location. These anchor lights provide the primary measure of safety to the boat's occupants and to other boats that may approach in the dark. However, when/if light bulbs and batteries fail and/or dim, or if the boat's operator simply forgets to turn on their lights, the degree of safety provided to people on boats at anchor or approaching is substantially reduced, or may even be eliminated.

This invention relates to a reflectorized device that, when illuminated by the spot/search lights of approaching craft, visually identifies the location of pleasure boats (power or sail) that are at anchor in dark, dusk, or unfavorably lit conditions.

This device is not intended to replace a boat's traditional battery or electric powered anchor light, but in the event a boat's anchor light fails, the device affords an additional level of safety by providing a visual identification of the anchored boat's location when the reflectorized device is illuminated by the spot/search light of an approaching vessel.

BRIEF SUMMARY OF THE INVENTION

This invention is directed to a device for visually identifying the location of pleasure craft that are at anchor at night. The object of the present invention is to provide the capability for approaching vessels to "see" the location of a boat at anchor when the device is illuminated by the spot/search light of an approaching vessel. The device is passive unless/until the reflectorized material is "activated" by a light source.

The collar shaped device is made of reflectorized sponge rubber that is designed for placement around a boat's anchor light pole, any portion of a boat's deck railings, the anchor line, or any suitably sized exterior feature. The device has an opening slit along it's entire body to afford quick and easy mounting and removal. The sponge rubber material provides buoyancy to aid in retrieval should the device accidentally fall overboard.

DETAILED DESCRIPTION OF THE INVENTION

Figure 1:
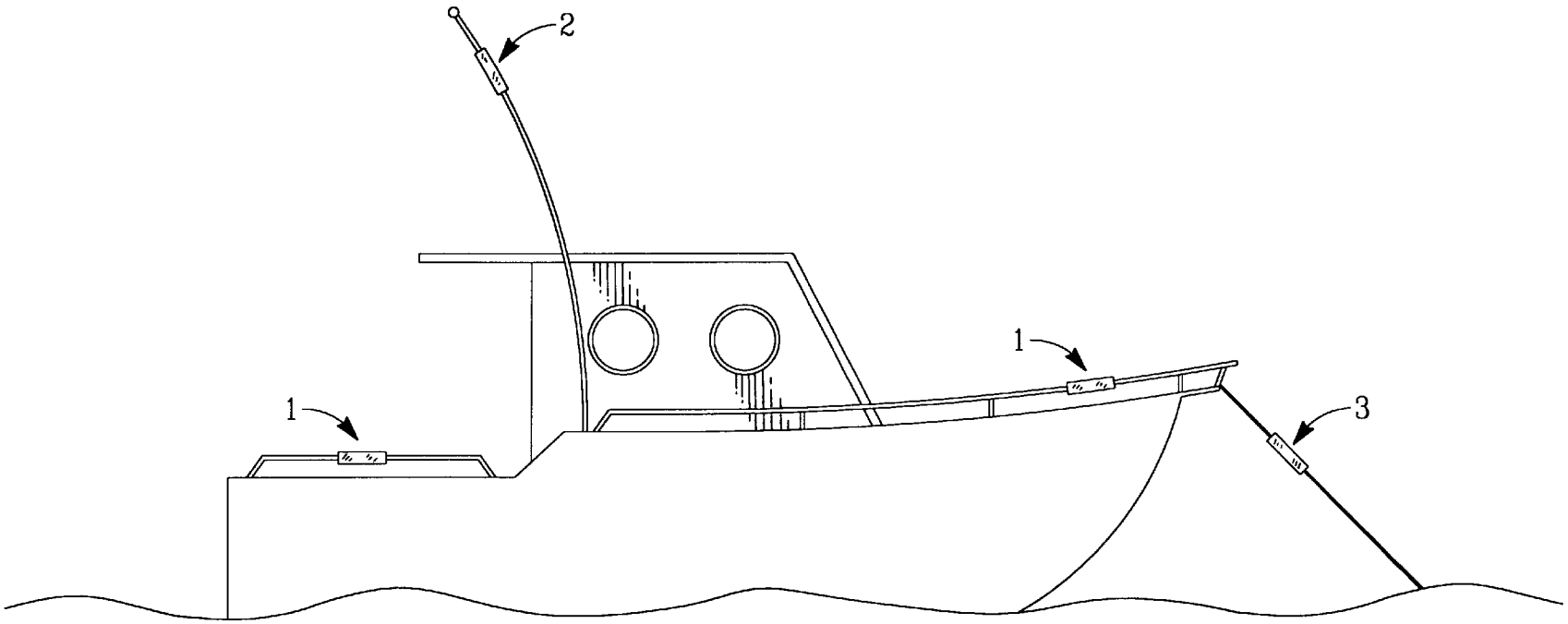
FIG. 1 is a perspective view of the invention shown attached to a boat's anchor light pole, deck railing, and anchor line.
Figure 2:
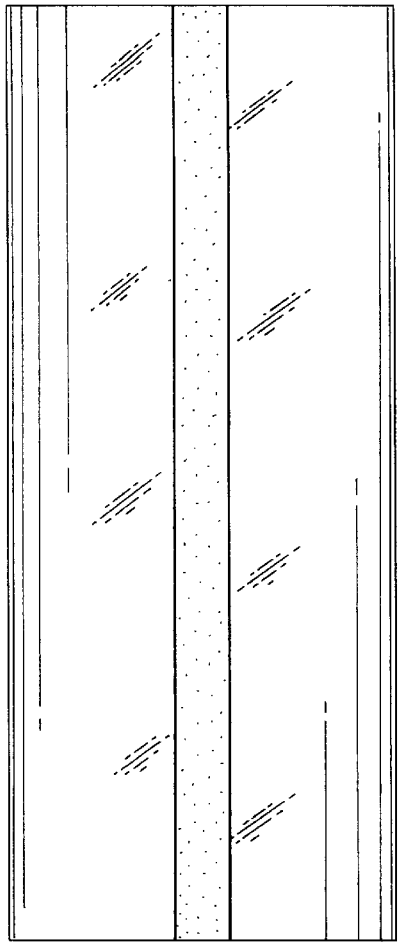
FIG. 2 is a front elevation view of the Sea Flector.
Figure 3:
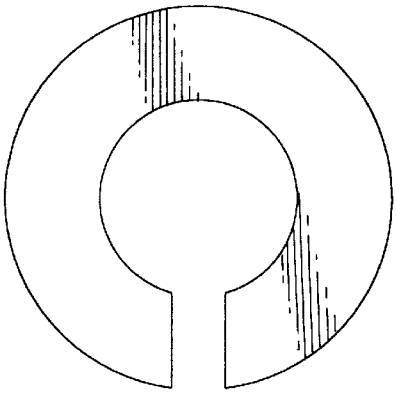
FIG. 3 is a top elevation view; the opposite side being a mirror image thereof.

Referring to FIG. 1, 'Sea Flectors' are used by placing them, for example, over a boat's deck railing (1), anchor light pole (2), and anchor line (3). The 'Sea Flector' is attached by aligning the opening slit with the light pole or deck railing and exerting a slight downward force with the hand. The opening slit runs the full length along the outside of the device (See FIG. 2).

The device is made of a light weight, reflectorized foam rubber material and is approximately 8" long, approximately 3' in diameter, and approximately 2" in circumference.

I claim:

1. A reflectorized device for providing visual identification of a boat's location in the dark, said device comprising:

a flexible, hollow, substantially cylindrical member made of reflectorized, water-buoyant, foam rubber, and defining first and second opposed open ends and further defining an opening slit extending between said open ends for removably attaching said device to a portion of said boat.

2. A method of providing visual identification of a boat's location in the dark comprising the steps of:

providing a flexible, hollow, substantially cylindrical member made of reflectorized, water-buoyant, foam rubber defining first and second opposed ends and further defining an opening slit extending between said open ends for removably attaching said member to a portion of said boat;

positioning said member with said opening slit in alignment with said portion of said boat; and exerting a force against said member to attach said member to said portion of said boat by forcing said slit over and around said portion of said boat, whereby said hollow member is positioned around and held on said portion of said boat.

* * * * *